US009837065B2

(12) United States Patent
Lee et al.

(10) Patent No.: US 9,837,065 B2
(45) Date of Patent: Dec. 5, 2017

(54) VARIABLE BANDWIDTH DELAYLESS SUBBAND ALGORITHM FOR BROADBAND ACTIVE NOISE CONTROL SYSTEM

(71) Applicants: Ford Global Technologies, LLC, Dearborn, MI (US); University of Cincinnati, Cincinnati, OH (US)

(72) Inventors: Ming-Ran Lee, Troy, MI (US); Takeshi Abe, Garden City, MI (US); Ming-te Cheng, Ann Arbor, MI (US); Frederick Wayne Vanhaaften, Northville, MI (US); Liqun Na, Northville, MI (US); Teik Lim, Mason, OH (US); Mingfeng Li, Cincinnati, OH (US); Guohua Sun, Cincinnati, OH (US); Tao Feng, Cincinnati, OH (US)

(73) Assignee: Ford Global Technologies, LLC, Dearborn, MI (US)

( * ) Notice: Subject to any disclaimer, the term of this patent is extended or adjusted under 35 U.S.C. 154(b) by 33 days.

(21) Appl. No.: 14/563,199

(22) Filed: Dec. 8, 2014

(65) Prior Publication Data

US 2016/0163305 A1 Jun. 9, 2016

(51) Int. Cl.
*G10K 11/16* (2006.01)
*G10K 11/178* (2006.01)

(52) U.S. Cl.
CPC .. *G10K 11/178* (2013.01); *G10K 2210/12821* (2013.01); *G10K 2210/3012* (2013.01); *G10K 2210/3053* (2013.01)

(58) Field of Classification Search
CPC ..... G10K 11/178; G10K 11/1784; G10K 11/1786; G10K 11/1788; G10K 2210/128;
(Continued)

(56) References Cited

U.S. PATENT DOCUMENTS 5,377,276 A * 12/1994 Terai ..... G10K 11/1784 381/71.11
5,410,605 A * 4/1995 Sawada ..... G10K 11/1786 381/71.11

(Continued)

FOREIGN PATENT DOCUMENTS

GB 2439988 A 1/2008

OTHER PUBLICATIONS

Griesbach, Jacob D., et al., Transactions Briefs: Subband Adaptive Filtering Decimation Constraints for Oversampled Nonuniform Filterbanks, IEEE Transactions on Circuits and Systems—II: Analog and Digital Signal Processing, vol. 49, No. 10, Oct. 2002, 5 pages.

(Continued)

*Primary Examiner* — Thang Tran
(74) *Attorney, Agent, or Firm* — Frank MacKenzie; Brooks Kushman P.C.

(57) ABSTRACT

An active noise control (ANC) system includes a speaker and one or more processors programmed to implement a delayless subband filtered-x least mean square control algorithm. The algorithm includes a variable bandwidth discrete Fourier transform filter bank having a number of subbands such that the system, in response to a broadband white noise reference signal indicative of road noise in the vehicle, exhibits a uniform gain spectrum across a frequency range defined by the subbands and partially cancels the road noise via output of the speaker.

12 Claims, 10 Drawing Sheets

(58) Field of Classification Search
CPC ... G10K 2210/1282; G10K 2210/3012; G10K 2210/3053; H04R 3/00; H04R 3/005; H04R 1/1083; H04R 2410/05; G10L 2021/02082; G10L 21/0208
See application file for complete search history.

(56) References Cited

U.S. PATENT DOCUMENTS

| | | | | |
|---|---|---|---|---|
| 5,933,495 | A * | 8/1999 | Oh | H04M 1/6033 370/289 |
| 8,111,840 | B2 * | 2/2012 | Haulick | H04M 9/082 381/318 |
| 8,260,607 | B2 | 9/2012 | Villemoes et al. | |
| 8,280,065 | B2 | 10/2012 | Nadjar et al. | |
| 8,477,955 | B2 | 7/2013 | Engle et al. | |
| 8,718,291 | B2 | 5/2014 | Alves et al. | |
| 2004/0247137 | A1 * | 12/2004 | Inoue | G10K 11/1784 381/71.4 |
| 2006/0034447 | A1 * | 2/2006 | Alves | H04M 9/082 379/406.01 |
| 2007/0041575 | A1 * | 2/2007 | Alves | H04M 9/082 381/71.1 |
| 2008/0310644 | A1 * | 12/2008 | Alves | H04M 9/082 381/66 |
| 2009/0175461 | A1 * | 7/2009 | Nakamura | G10K 11/1788 381/71.1 |
| 2009/0279710 | A1 * | 11/2009 | Onishi | G10K 11/1784 381/71.4 |
| 2010/0177905 | A1 * | 7/2010 | Shridhar | G10K 11/1782 381/71.11 |
| 2010/0266134 | A1 * | 10/2010 | Wertz | G10K 11/178 381/71.1 |
| 2010/0284546 | A1 | 11/2010 | Debrunner et al. | |
| 2013/0083939 | A1 | 4/2013 | Fellers et al. | |
| 2013/0182868 | A1 * | 7/2013 | Krini | G10K 11/002 381/94.3 |
| 2014/0072135 | A1 * | 3/2014 | Bajic | G10K 11/1784 381/71.11 |
| 2015/0256928 | A1 * | 9/2015 | Mizuno | G01S 15/08 381/56 |

OTHER PUBLICATIONS

Rao, Mohan D., Recent Applications of Viscoelastic Damping for Noise Control in Automobiles and Commercial Airplanes, Journal of Sound and Vibration, vol. 262, 2003, 18 pages.
Galijasevic, Enisa, et al., Non-Uniform Near-Perfect-Reconstruction Oversampled DFT Filter Banks Based on Allpass-Transforms, Proceedings of the Ninth IEEE DSP Workshop, Oct. 15-18, 2000, Hunt, Texas, 6 pages.
Huo, Jiaquan, et al., New Weight Transform Schemes for Delayless Subband Adaptive Filtering, IEEE, 2001, 5 pages.
Zhang, Yu, et al., Lightweight Design of Automotive Front Side Rail Based on Robust Optimisation, Thin-Walled Structures, vol. 45, 2007, 7 pages.
Shynk, John, J., Frequency-Domain and Multirate Adaptive Filtering, IEEE SP Magazine, Jan. 1992, 24 pages.
Vaidyanathan, P.P., Multirate Systems and Filter Banks, Prentice Hall Signal Processing Series, California Institute of Technology, Dept. of Elec. Eng., 1993, ISBN 0-13-605718, 464 pages.
Kuo, Sen M., et al., Active Noise Control Systems, Algorithms and DSP Implementations, Wiley Series in Telecommunications and Signal Processing, 1996, 408 pages.
Gilloire, Andre, et al., Adaptive Filtering in Subbands with Critical Sampling: Analhysis, Experiments, and Application to Acoustic Echo Cancellation, IEE Transactions on Signal Processing, vol. 40, No. 8, Aug. 1992, 14 pages.
Sano, Hisashi, et al., Active Control System for Low-Frequency Road Noise Combined with an Audio System, IEEE Transactions on Speech and Audio Processing, vol. 9, No. 7, Oct. 2001, 9 pages.
Duan, Jie, Active Control of Vehicle Powertrain Noise Applying Frequency Domain Filtered-x LMS Algorithm, University of Cincinnati, PhD Thesis for the degree of Mechanical Engineering, May 7, 2009, 55 pages.
Duan, Jie, Active Control of Vehicle Powertrain and Road Noise, a dissertation submitted to the Graduate School of the University of Cincinnati in partial fulfillment of the requirements for the degree of Doctor of Philosophy, Jun. 1, 2011, 212 pages.
Cheer, Jordan, Active Control of the Acoustic Environment in an Automobile Cabin, University of Southampton, Faculty of Engineering and the Environment, Institute of Sound and Vibration Research, PhD Thesis for the degree of Doctor of Philiosophy, Dec. 2012, 389 pages.
Dehandschutter, W., et al., Active Control of Structure-Borne Road Noise Using Vibration Actuators, Journal of Vibration and Acoustics, vol. 120, Apr. 1998, 7 pages.
Sutton, Trevor J., et al., Active Control of Road Noise Inside Vehicles, Institute of Noise Control Engineering Journal 42, No. 4, Jul. 1994, 11 pages.
Elliott, S.J., et al., The Active Control of Low Frequency Engine and Road Noise Inside Automotive Interiors, Active Noise and Vibration Control Journal, Annual Meeting of American Society of Mechanical Engineers, vol. 8, Nov. 1990, 6 pages.
Elliott, S.J., A Review of Active Noise and Vibration Control in Road Vehicles, Institute of Sound and Vibration Research, ISVR Technical Memorandum No. 981, Dec. 2008, 25 pages.
Morgan, Dennis R., et al., A Delayless Subband Adaptive Filter Architecture, IEEE Transactions on Signal Processing, vol. 43, No. 8, Aug. 1995, 12 pages.
Park, Seon Joon, et al., A Delayless Subband Active Noise Control System for Wideband Noise Control, IEEE Transactions on Speech and Audio Processing, vol. 9, No. 8, Nov. 2001, 8 pages.
Merched, R., A Delayless Alias-Free Subband Adaptive Filter Structure, Proceedings of IEEE International Symposium, Circuits and Systems, vol. 4, Jun. 9-12, 1997, 1 page.
Dixit, R.K., Global Journal of Researches in Engineering: F, Electrical and Electronic Engineering, 2014, vol. 14, Issue 1, Version 1.0, 91 pages.

* cited by examiner

VARIABLE BANDWIDTH DELAYLESS SUBBAND ALGORITHM FOR BROADBAND ACTIVE NOISE CONTROL SYSTEM

TECHNICAL FIELD

This application relates to vehicle active noise control systems.

BACKGROUND

In recent years, lightweight design has helped achieve more energy efficient vehicles. It has also been estimated that fuel economy may increase 6 to 8% if vehicle weight is decreased by 10%. Lightweight design, however, may increase structural vibration and consequently interior noise, especially at low frequencies. And, passive noise control may not be ideal because it tends to add to vehicle weight and cost. As such, active noise control (ANC) technology has been developed that uses the audio system as a secondary speaker to control engine noise, powertrain noise and road noise.

SUMMARY

In many active noise control (ANC) applications, computational burden and slow converging speed caused by large reference signal eigenvalue spread are a concern. A delayless subband algorithm which decomposes the signals from full band into a set of subbands was previously introduced to reduce the computational complexity and improve the convergence property of the control system. Here, a detailed derivation of a uniform delayless subband algorithm is introduced. Furthermore, the inherent limitation of the uniform discrete Fourier transform (DFT) filter bank is discussed. (An aliasing problem between adjacent subbands was found.) This inherent aliasing effect may degrade system performance. Hence, a variable bandwidth delayless subband algorithm, in one example, is proposed as the basis of an active noise control system for various types of road noises. This algorithm may be capable of overcoming the aliasing effect of the standard delayless subband algorithm. This algorithm, in certain implementations, is effective and has low computational cost. To validate the performance of the proposed algorithm, numerical simulations were conducted for controlling the measured road noises. The simulation results indicate that the variable bandwidth delayless subband algorithm is an option for broadband ANC system implementation.

In one example, a vehicle has an active noise control system including a processor. The processor implements a delayless subband filtered-x least mean square control algorithm including a variable bandwidth discrete Fourier transform filter bank having a number of subbands such that the system, in response to a broadband white noise reference signal indicative of road noise in the vehicle, exhibits a uniform gain spectrum across a frequency range defined by the subbands and partially cancels the road noise. The delayless subband filtered-x least mean square control algorithm may further include a uniform filter bank. Center frequencies of the variable bandwidth discrete Fourier transform filter bank may be offset from center frequencies of the uniform filter bank by one half a bandwidth of the uniform filter bank. A bandwidth of the variable bandwidth discrete Fourier transform filter bank may be less than the bandwidth of the uniform filter bank. A bandwidth of the variable bandwidth discrete Fourier transform filter bank may be at least one half the bandwidth of the uniform filter bank. The active noise control (ANC) system may further include a speaker. The ANC system may partially cancel the road noise via output of the speaker.

DETAILED DESCRIPTION

Figure 1:
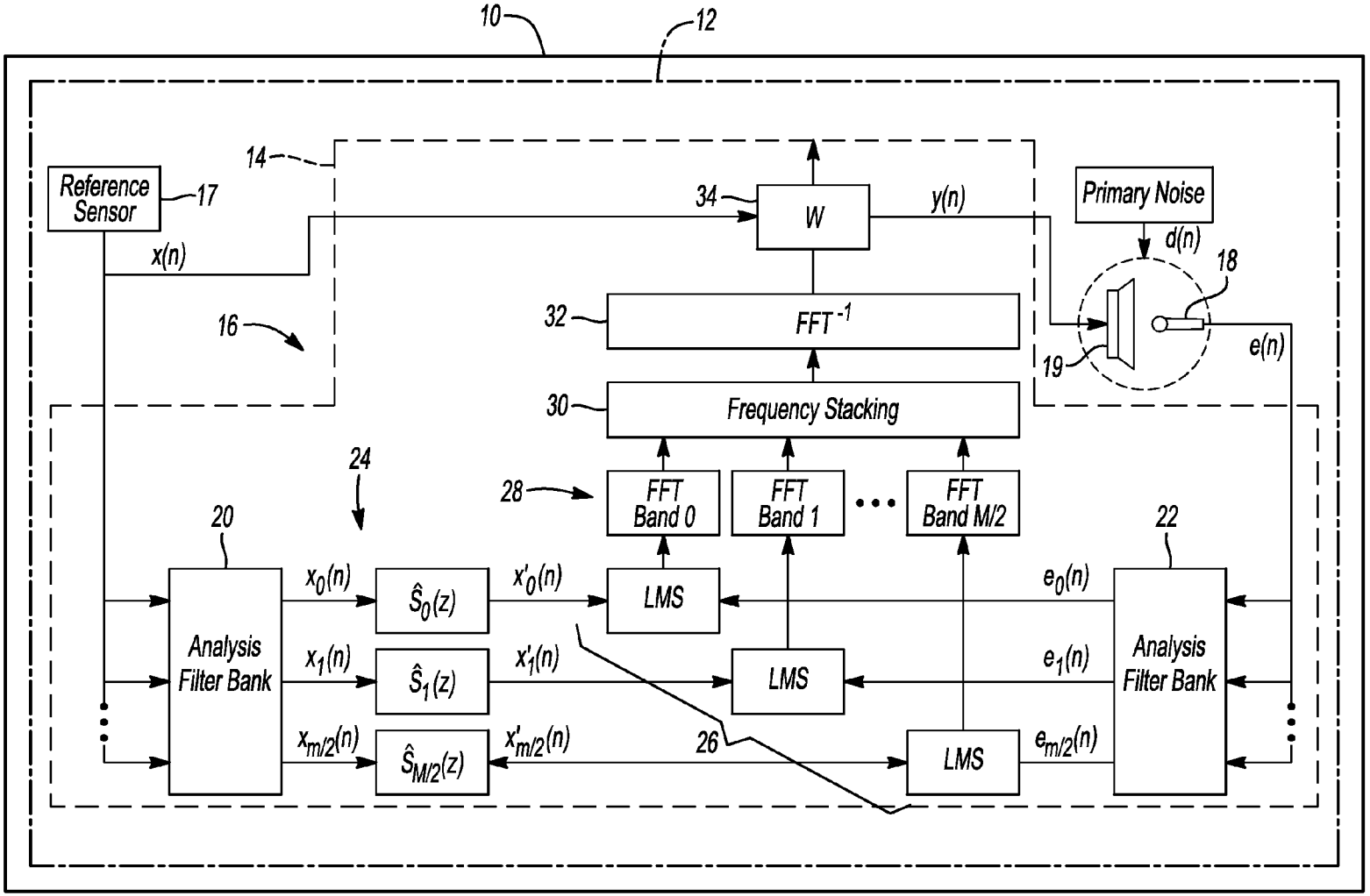
FIG. 1 is a diagram of single-input single-output (SISO) delayless subband algorithm within the context of an active noise control system for a vehicle.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

INTRODUCTION

Active noise control (ANC) is based on the principle of superposition, and the unwanted primary noise is cancelled by a secondary noise of equal amplitude and opposite phase. Generally, the road noise is a colored broadband noise with energy lying in the frequency range 60-400 Hz. Many have attempted to develop a feasible ANC system for vehicle applications in the last three decades. For instance, a feasible way to control road noise using an ANC system was shown a number of years ago. Later, a multi-channel ANC system was developed by utilizing the conventional filtered-x least mean square (FXLMS) algorithm to control road noise along with reference accelerometers and a secondary speaker. This was followed by an ANC system combined with a vehicle audio system, and a real-time ANC system with the common FXLMS algorithm. Most of these examples use the conventional FXLMS algorithm. This algorithm, however, has inherent drawbacks to controlling road noise because broadband noise requires a high-order adaptive filter that increases the computational burden, and the step size of this algorithm is not suitable for all frequencies due to the large eigenvalue spread of the colored reference signal, which results in slow convergence speed.

To overcome the above problems, a subband algorithm based on the FXLMS algorithm was previously developed. This reduced the computational burden because adaptive filtering is performed at a lower decimation rate. And, fast convergence is possible because the spectral dynamic range is reduced in each subband. Furthermore, subband algorithms have been used in acoustic echo cancellation. Unfortunately, such techniques cannot be directly applied to an ANC system because of undesirable delays introduced into the signal path. These delays limit algorithm performance and stability. Hence, a delayless subband algorithm for ANC applications was proposed. The signal path delays were avoided while retaining the advantage of a subband algorithm. More recently, a combined feedforward and feedback ANC system based on the delayless subband algorithm to control interior road noise was developed. The traditional delayless subband algorithm, however, has an inherent limitation associated with the uniform discrete Fourier transform (DFT) analysis filter bank, which will lead to aliasing effects due to spectral leakages between adjacent filter banks. Here, a variable bandwidth DFT analysis filter bank design is presented to minimize the aliasing effect and reduce computational burden.

Variable Bandwidth Delayless Subband Algorithm

Uniform Delayless Subband Algorithm

FIG. 1 shows a diagram of a vehicle 10 including an active noise control (ANC) system 12. The ANC system 12, in this example, includes at least one processor 14 implementing a single-input and single-output Morgan delayless subband algorithm 16, where x(n) is the reference signal that is picked up by accelerometers and/or microphones 17, d(n) is the primary noise picked up by microphone 18, and e(n) is the error signal after superposition of the primary noise and secondary canceling noise. The secondary canceling noise is output to a cabin of the vehicle 10 via speaker 19. The algorithm 16 includes analysis filter banks 20, 22, subband secondary path blocks 24, least mean square (LMS) algorithm blocks 26, Fast Fourier transform (FFT) blocks 28, frequency stacking block 30, inverse FFT block 32, and adaptive filter block 34. As shown, the analysis filter bank consists of M subbands (note M is an even number). For real signals, only M/2+1 subbands are needed. These M/2+1 subbands correspond to the positive frequency components of the wideband filter response; the others are formed by complex-conjugate symmetry. The reference signal x(n) and the error signal e(n) are decomposed into sets of sub-band signals. This arrangement can of course be extended to a multi-channel configuration.

The reference subband signal vector $x_m(n)$ and the error signal $e_m(n)$ are expressed as $$x_m(n)=[x(nD+m)x((n-1)D+m)\ \ldots\ x((n-K-1)D+m)]^T \tag{1}$$

$$e_m(n)=[e(nD+m)e((n-1)D+m)\ \ldots\ e((n-K-1)D+m)]^T \tag{2}$$

where m=0, 1, . . . , D, the decimation factor D=M/2, N is the length of fullband adaptive filter, and K is the number of weights for each sub-band adaptive filter K=N/D.

As a result of the decimation factor, D, all the subband adaptive filter weights are updated every D samples. And, the fullband $\hat{S}(z)$ is decomposed into a set of subband functions $\hat{S}_0(z), \hat{S}_1(z), \ldots, \hat{S}_{M-1}(z)$. These subband transfer functions can be estimated using offline or online system identification approaches in which the broadband noise generator can be decomposed into corresponding subbands. Hence, the filtered reference signal in each subband is $$x'_m{}'(k)=x_m(k)*\hat{s}_m \tag{3}$$

where * denotes the convolution process.

The m-th subband adaptive filter can be updated using the complex normalized least-mean-square algorithm as $$w_m(n+D) = w_m(n) + \mu\frac{x'^*_m(n)}{\|x'_m(n)\|^2+\alpha}e_m(n) \tag{4}$$

where $w_m(n)=[w_{m_0}(n)\ w_{m_1}(n)\ \ldots\ w_{m_{K-1}}(n)]^T$ is the subband adaptive weight vector for the m-th subband and α is a small constant value to avoid infinite step size. Then, these subband adaptive weights are transformed to fullband via a weight transformation scheme. There are several weight transformation techniques known in the art. Here, the FFT-stacking method is adopted and obtains the fullband adaptive weight.

In the delayless subband algorithm, a fullband signal is decomposed into subband signals, which derives a set of adaptive sub-filters. And, this process is primarily dependent on the characteristics of an analysis filter bank. Presently, the analysis filter bank is mainly based on multi-rate signal processing techniques and different filter bank approaches have been developed over the last twenty years. Among those filter banks, the cosine modulated filter bank is popular because it is easy to implement and provides a perfect reconstruction. And, the DFT poly-phase filter bank is another popular filter bank that provides high computational efficiency and simple structure. For the delayless subband algorithm, the DFT filter bank is selected due to some key advantages in the filter structure and computational efficiency.

Uniform DFT Analysis Filter Bank Design

Figure 2:
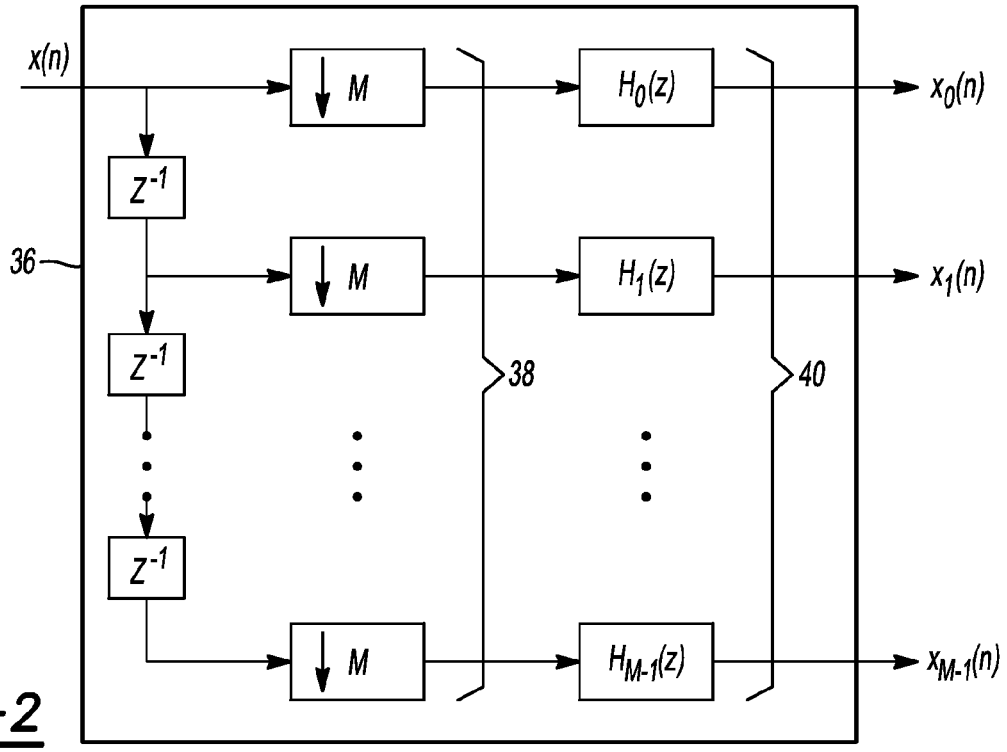
FIG. 2 is a diagram of a uniform discrete Fourier transform (DFT) analysis filter bank.

FIG. 2 shows the structure of a uniform DFT filter bank 36 with a number of M subbands 38. The DFT filter bank 36 may be used within the context of the ANC system 12 of FIG. 1 instead of, for example, the analysis filter bank 20, and is derived from a prototype filter P(z) via modulation. Specifically, the analysis filter bank 36 of M subbands 38 is obtained via complex modulation in the following equation:

$$H_i(z) = P(ze^{-\frac{j2\pi i}{M}}),\ i = 0, 1, \ldots, M-1 \tag{5}$$

where P(z) is the real-valued prototype low-pass filter with a cutoff frequency of π/M. Then, the complex-modulated filters $H_i(z)$ 40 are obtained by shifting the low-pass filter P(z) to the right by multiples of $2\pi/M$. Therefore, the uniform DFT filter bank 36 can divide the normalized frequency range from 0 to $2\pi$ into M subbands 38 with a distance of $2\pi/M$ between adjacent filters 40.

Figure 3A:
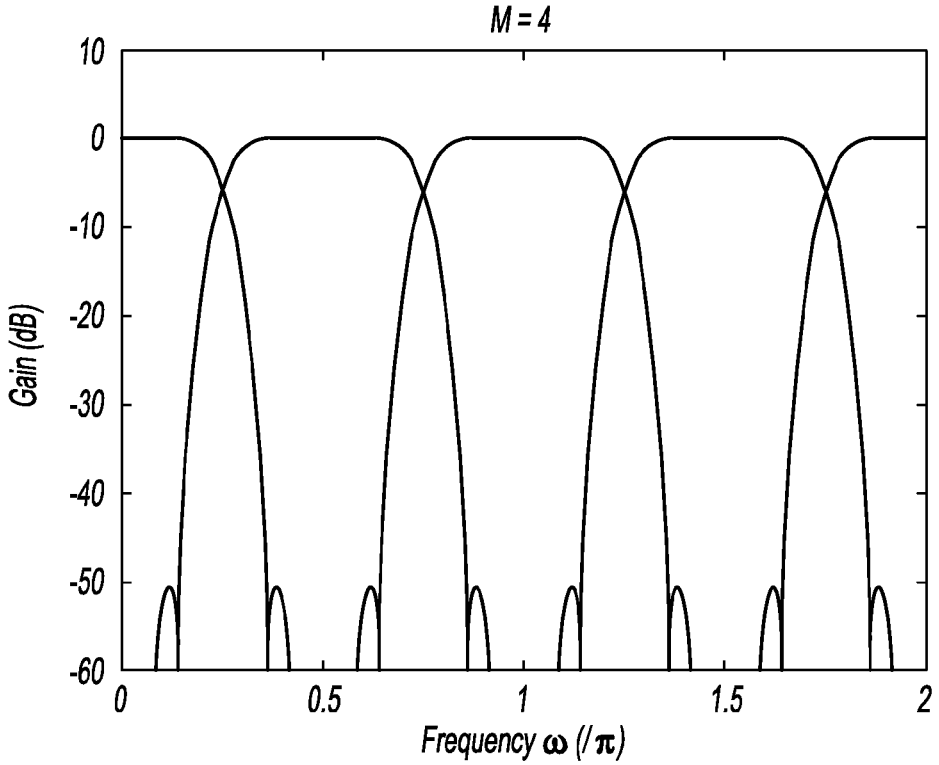
FIGS. 3A and 3B are plots of magnitude responses of DFT filter banks for different numbers of subbands.
Figure 3B:
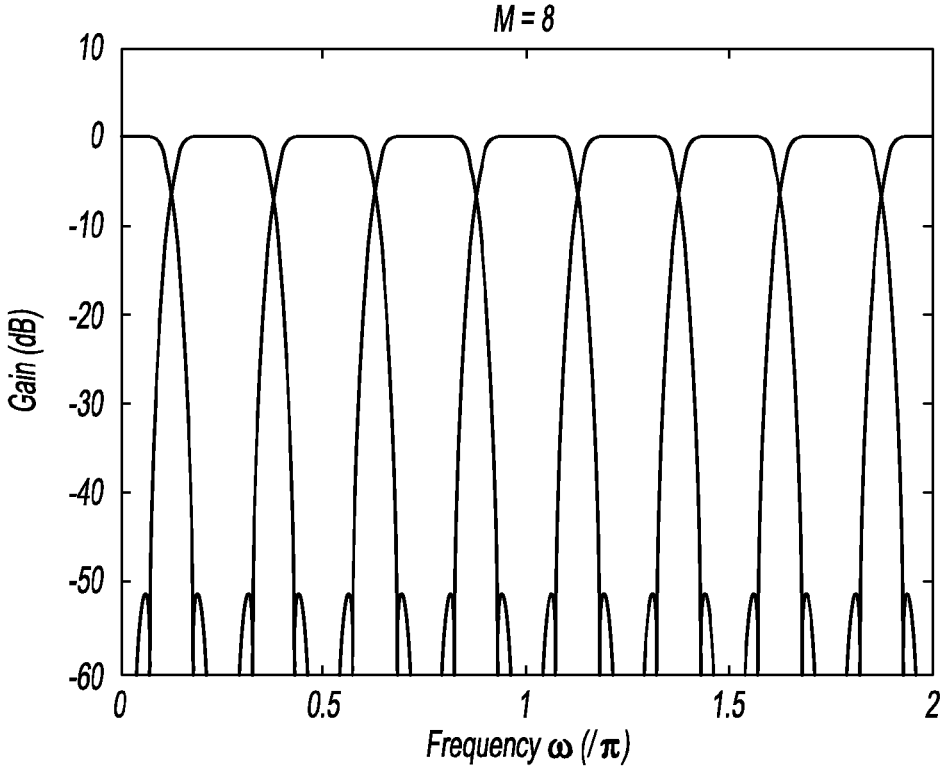

FIGS. 3A and 3B show the uniform DFT analysis filter bank designed for different subband numbers M. As shown for different subband numbers M, spectral leakage to adjacent sub-bands is unavoidable and will lead to the aliasing effect. When increasing the number of subbands, there still is a leakage among the subbands. So, the uniform DFT filter bank suffers from the fact that it is not able to cancel aliasing components caused by the inherent drawback of the uniform DFT filter bank. Thus, an objective of DFT filter bank design may be to minimize or limit the spectral leakage in order to eliminate the aliasing effect. A new design of a DFT filter bank, the non-uniform DFT filter bank, is introduced here to overcome this disadvantage via a structure with inherent alias cancellation.

Variable Bandwidth DFT Analysis Filter Bank Design

The variable bandwidth DFT analysis filter bank is based on the previously proposed non-uniform DFT analysis filter bank. Other non-uniform subband methods such as non-uniform pseudo-quadrature mirror filter (QMF) banks and allpass-transformed DFT filter banks have inherent limitations. For example, the non-uniform pseudo-QMF is only used in the traditional subband algorithm that needs both analysis and synthesis filters, which is considered to not be appropriate for the delayless subband algorithm. Also, the allpass-transformed DFT filter bank is only realized by changing the bandwidths, which cannot remove the aliasing effect.

Figure 4:
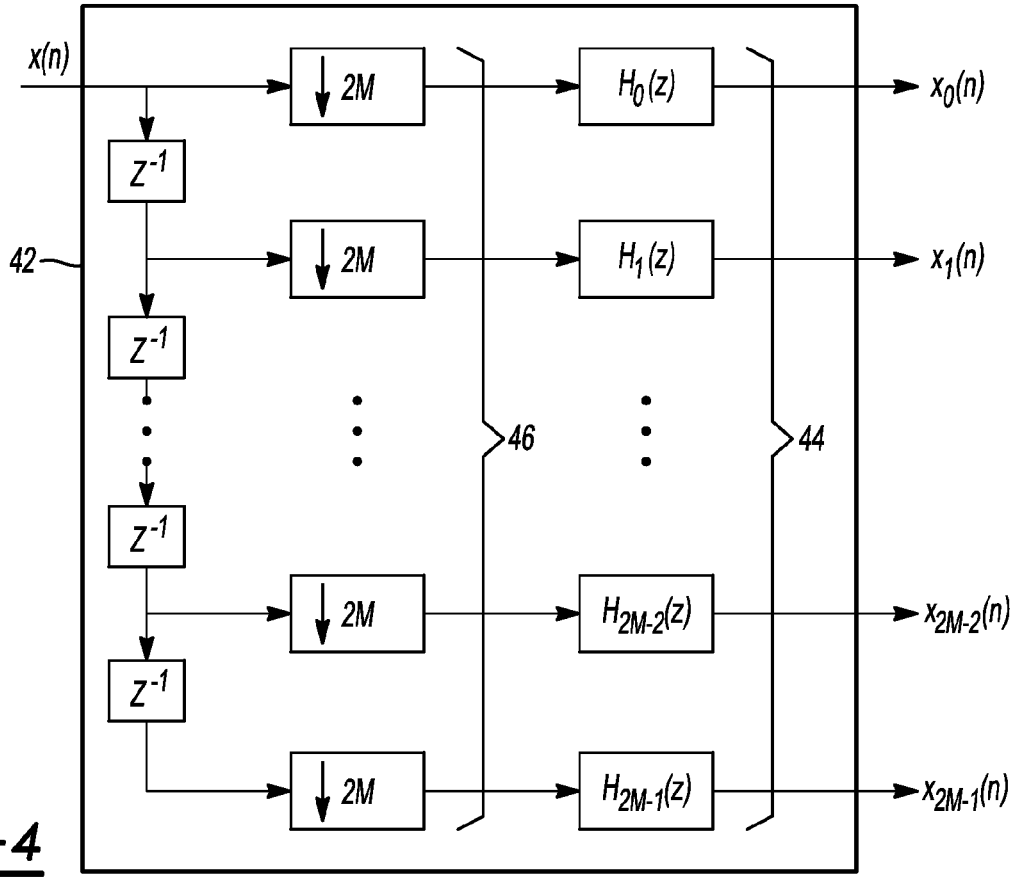
FIG. 4 is a diagram of a variable bandwidth DFT analysis filter bank.

FIG. 4 shows an example structure of a variable bandwidth DFT analysis filter bank 42. The variable bandwidth DFT analysis filter bank 42 may be used within the context of the ANC system 12 of FIG. 1 instead of, for example, the analysis filter bank 20, etc. For this filter bank, two different prototype filters $P_1(z)$ and $P_2(z)$ are utilized. The prototype filters $P_1(z)$ and $P_2(z)$ implement the classical method of windowed linear-phase finite impulse response (FIR) digital filter design. They can be designed using a MATLAB embedded function:

$$P_1(z)=fir1(K-1,\alpha) \tag{6}$$

$$P_2(Z)=fir1(K-1,\beta) \tag{7}$$

where K is the order of the prototype filter, M is the number of the uniform subband filter banks, $\alpha$ is the uniform coefficient that is equal to 1/M, and $\beta$ is the variable bandwidth coefficient that is between 1/2M and 1/M. Here, $\beta$ is set as equal to 1/2M.

The first prototype filter $P_1(z)$ is the real-valued low-pass filter with a cutoff frequency of $\pi\alpha$ to obtain all odd-numbered subbands, while the secondary prototype filter $P_2(z)$ is the real-valued low-pass filter with a cutoff frequency of $\pi\beta$ to obtain all even-numbered sub-bands. Specifically, analysis filter banks of M-bands variable bandwidth DFT filter banks $[H_0(z), H_1(z), H_2, \ldots, H_{2M-1}(z)]$ are obtained via complex modulation in the following equation:

$$H_i(z) = \begin{cases} P_1\left(ze^{-\frac{j\pi i}{M}}\right), & i = 0, 2, \ldots, 2M-2 \\ P_2\left(ze^{-\frac{j\pi i}{M}}\right), & i = 1, 3, \ldots, 2M-1 \end{cases} \tag{8}$$

Then, the complex-modulated filters $H_i(z)$ 44 are obtained by shifting two low-pass filters $P_1(z)$ and $P_2(z)$ to the right by multiples of $2\pi/M$. Therefore, the variable bandwidth DFT filter bank 42 can divide the normalized frequency range from 0 to $2\pi$ into 2M subbands 46.

Figure 5A:
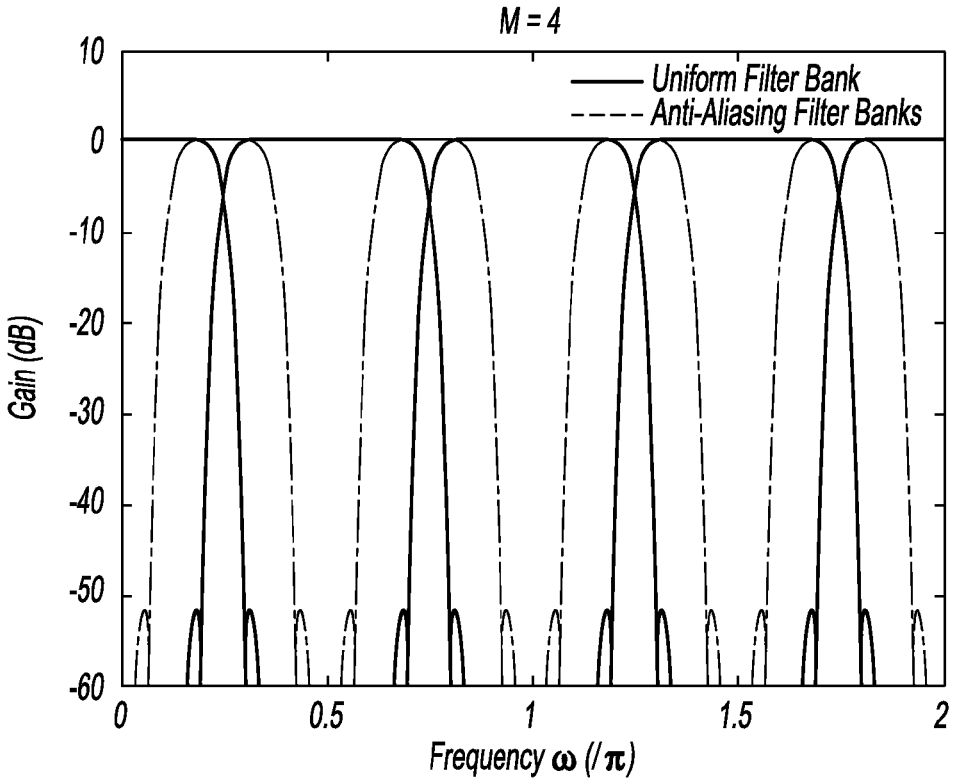
FIGS. 5A and 5B are plots of magnitude responses of variable bandwidth DFT filter banks for different numbers of subbands.
Figure 5B:
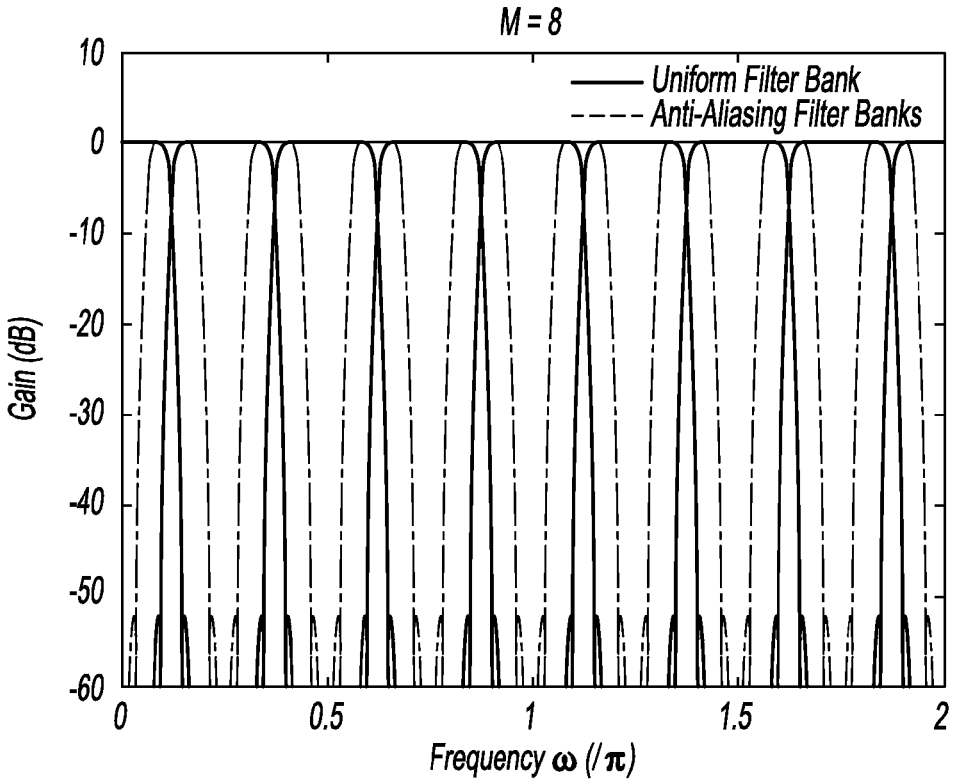

FIGS. 5A and 5B show the variable bandwidth DFT analysis filter bank design for different numbers of subbands. Here, $\beta$ is equal to 1/2M, and the even order $H_i(z)$ (i=1, 3, . . . , 2M−1) is added between the filter $H_i(z)$ (i=0, 2, . . . , 2M−2). It can cover the spectral leakage between the adjacent odd ordered filters. Therefore, the variable bandwidth DFT analysis filter banks can avoid and limit the aliasing effect in the delayless subband algorithm.

Computational Complexity

This section evaluates the computational complexity of uniform and non-uniform delayless subband algorithms. The computational requirements of the algorithms can be separated into five parts: 1) filter bank operation, 2) subband weight adaptation, 3) fullband filtering, 4) weight transformation, and 5) filtering of the reference signal. For convenience, the computational complexity is based on the number of multiplies per input sample. The computational complexity is summarized in Table 1.

TABLE 1

Computational Complexities of Morgan Delayless Sub-Band Algorithm

| Computational requirement | Uniform DFT filter bank | Variable bandwidth DFT filter bank |
|---|---|---|
| $C_1$: Filter bank operation | $4K/M + 4\log_2 M$ | $4K/M + 2\log_2 2M$ |
| $C_2$: Subband weight adaptation | $\frac{8N}{M} + \frac{16N}{M^2}$ | $\frac{4N}{M} + \frac{4N}{M^2}$ |
| $C_3$: Fullband filtering | N | N |
| $C_4$: Weight transformation | $\left[2\log_2\left(\frac{2N}{M}\right) + \log_2 N + \frac{4}{M}\log_2\left(\frac{2N}{M}\right)\right]J$ | $\left[2\log_2\left(\frac{N}{M}\right) + \log_2 N + \frac{2}{M}\log_2\left(\frac{N}{M}\right)\right]J$ |
| $C_5$: Filter-X signal generation | $\frac{8L}{M} + \frac{16L}{M^2}$ | $\frac{4L}{M} + \frac{4L}{M^2}$ |

In this table, N is the length of the fullband adaptive filter, K is the number of weights for each subband adaptive filter, and L is the length of the secondary path estimate filter $\hat{S}(z)$. Therefore, the required total multiplications of the uniform Morgan delayless subband algorithm is known to be $$N + \frac{4(K+2N+2L)}{M} + \frac{16(N+L)}{M^2} + \log_2 N + \left[2\log_2(M) + 3\log_2 N + \frac{4}{M}\log_2\left(\frac{2N}{M}\right)\right]J \tag{9}$$

where J is a variable that determines how often the weight transformation is performed. The delayless subband algorithm does not exhibit severe degradation in the performance for values of J in the range from one to eight. It should be noted that different computations are required for the proposed variable bandwidth Morgan delayless subband algorithm.

The number of computations for the subband filtering of the reference signal and the error signal are $$C_1 = \frac{2\times(K+2M\log_2 2M)}{2M/2} = \frac{2K}{M} + 2\log_2 2M \tag{10}$$

Here for the real signals, only M+1 complex subbands need to be processed. Thus, the subband weight update requires $$C_2 = \frac{4\times\left(\frac{2N}{2M}\right)\times(2M/2+1)}{2M/2} = \frac{4N}{M} + \frac{4N}{M^2} \tag{11}$$

To transform the subband weight into fullband weights, the weight transformation process requires $$C_4 = \frac{\left[(2M/2+1)\times\left(\frac{4N}{2M}\log_2\left(\frac{2N}{2M}\right)+N\log_2 N\right]\right.}{N/J} = \left[2\log_2\frac{N}{M} + \frac{2}{M}\log_2\frac{N}{M} + \log_2 N\right]J \tag{12}$$

Here, the output of the adaptive filter will have computational cost $C_3$=N. Assuming the secondary path is modeled with a L-th order FIR filter, generating the filtered reference signal requires $$C_5 = \frac{4\times\left(\frac{2L}{2M}\right)\times(2M/2+1)}{2M/2} = \frac{4L}{M} + \frac{4L}{M^2} \tag{13}$$

Therefore, the required total multiplications and additions of the variable bandwidth Morgan delayless subband algorithm is $$N + \frac{2(K+2N+2L)}{M} + \frac{4(N+L)}{M^2} + \log_2 N + \left[2\log_2(2M) + 3\log_2 N + \frac{2}{M}\log_2\left(\frac{N}{M}\right)\right]J \tag{14}$$

Figure 6:
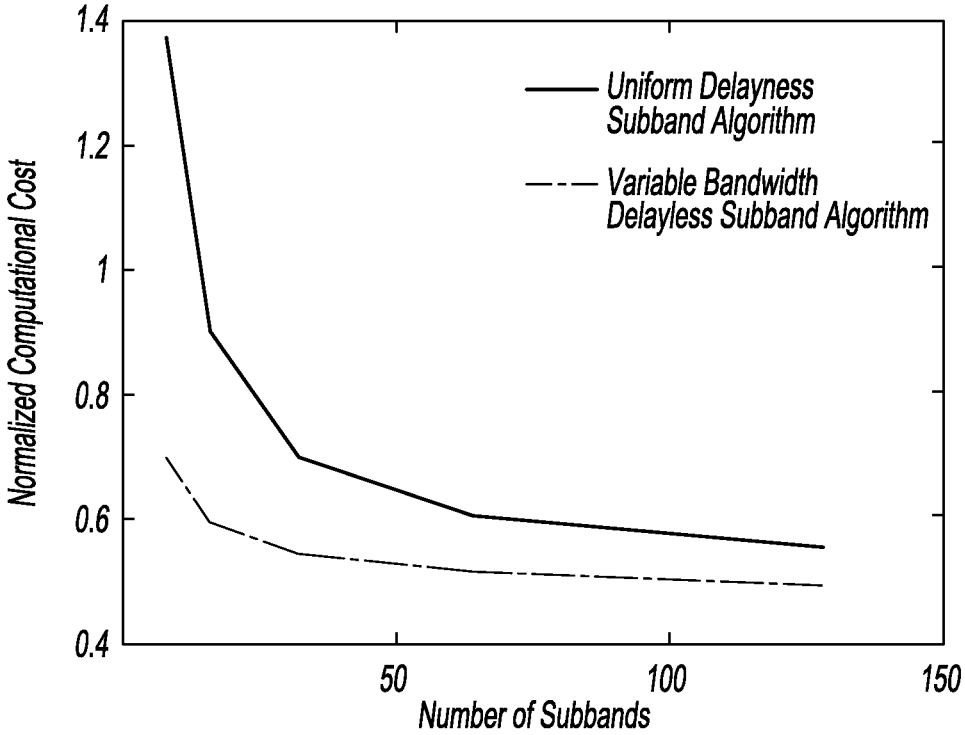
FIG. 6 is a plot of a comparison of computational complexity of different delayless subband algorithms.

FIG. 6 shows the comparison of the normalized computational complexity of these subband-based algorithms over the traditional FXLMS algorithm. Here, the length of the fullband adaptive filter N is 512-tap, the length of the estimated secondary path L is 256-tap, and the number of subbands M is 8, 16, 32, 64 and 128, respectively. As shown in FIG. 6, the computational complexity of these two algorithms is reduced as the number of sub-bands M is increased. In addition, the variable bandwidth delayless subband algorithm has a lower computational complexity than the uniform Morgan delayless subband algorithm. Therefore, the variable bandwidth delayless subband algorithm will further reduce the computational cost as the number of subbands increased.

Numerical Simulation

Figure 7A:
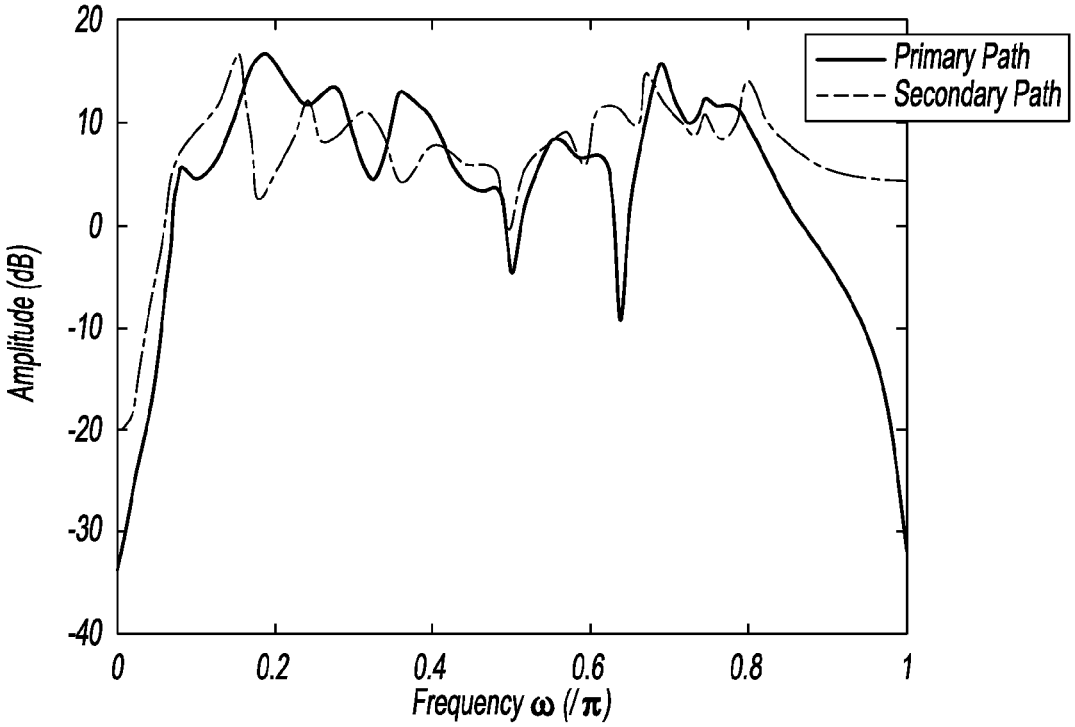
FIGS. 7A and 7B are plots of magnitude and phase responses, respectively, of primary and secondary paths.
Figure 7B:
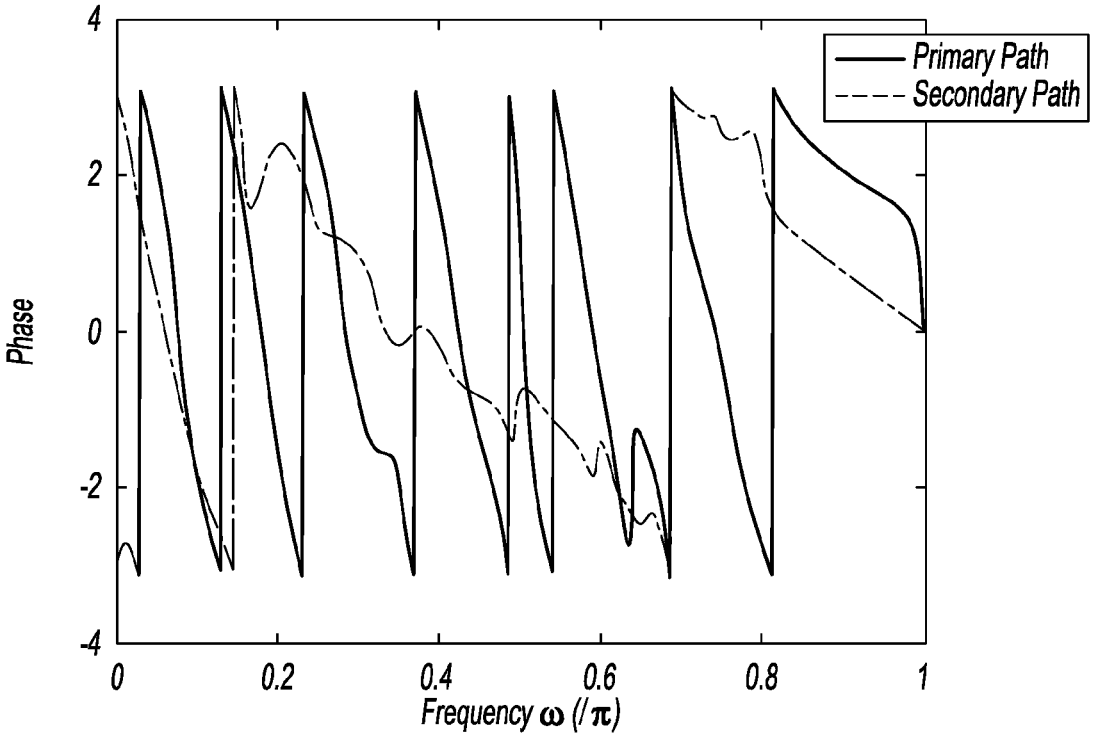
Figure 8A:
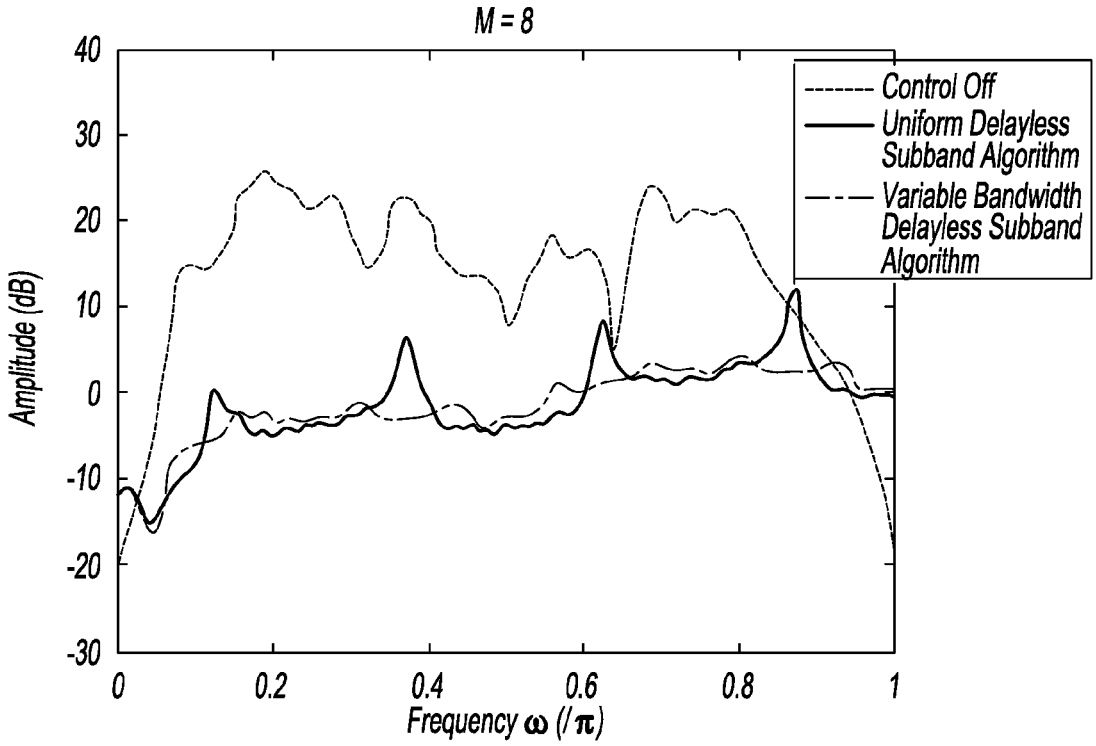
FIGS. 8A through 8D are plots of comparisons of steady-state performance of uniform and variable bandwidth delayless subband algorithms using different numbers of subbands for synthesized data.
Figure 8B:
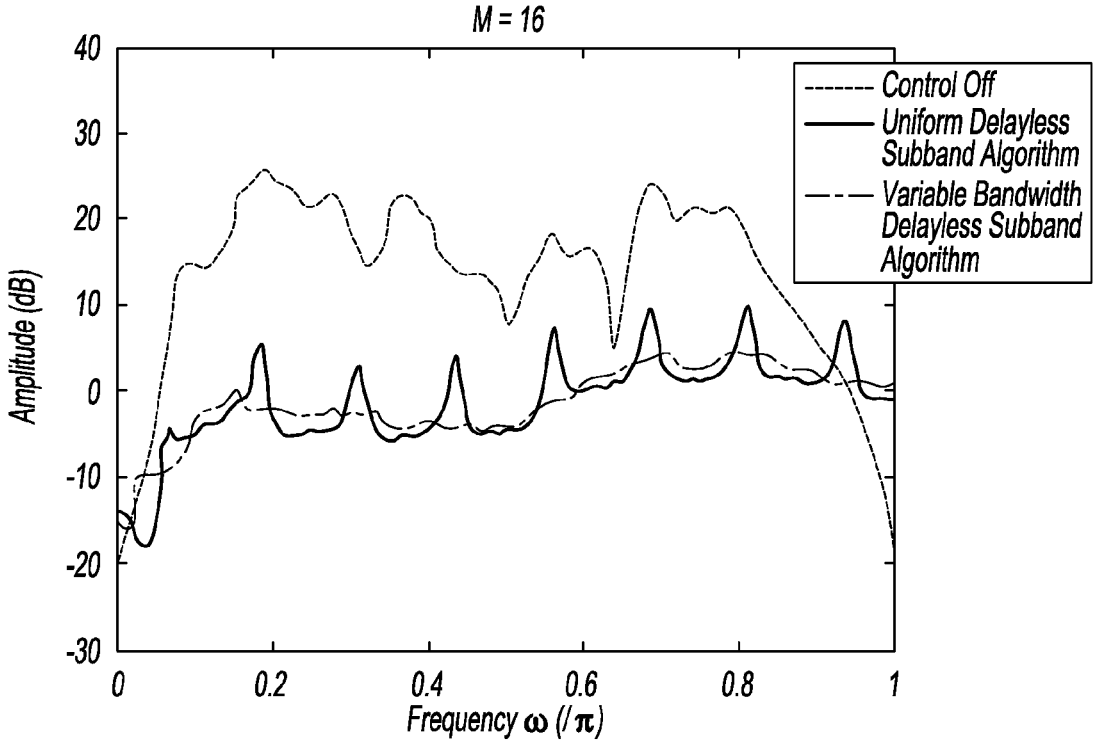
Figure 8C:
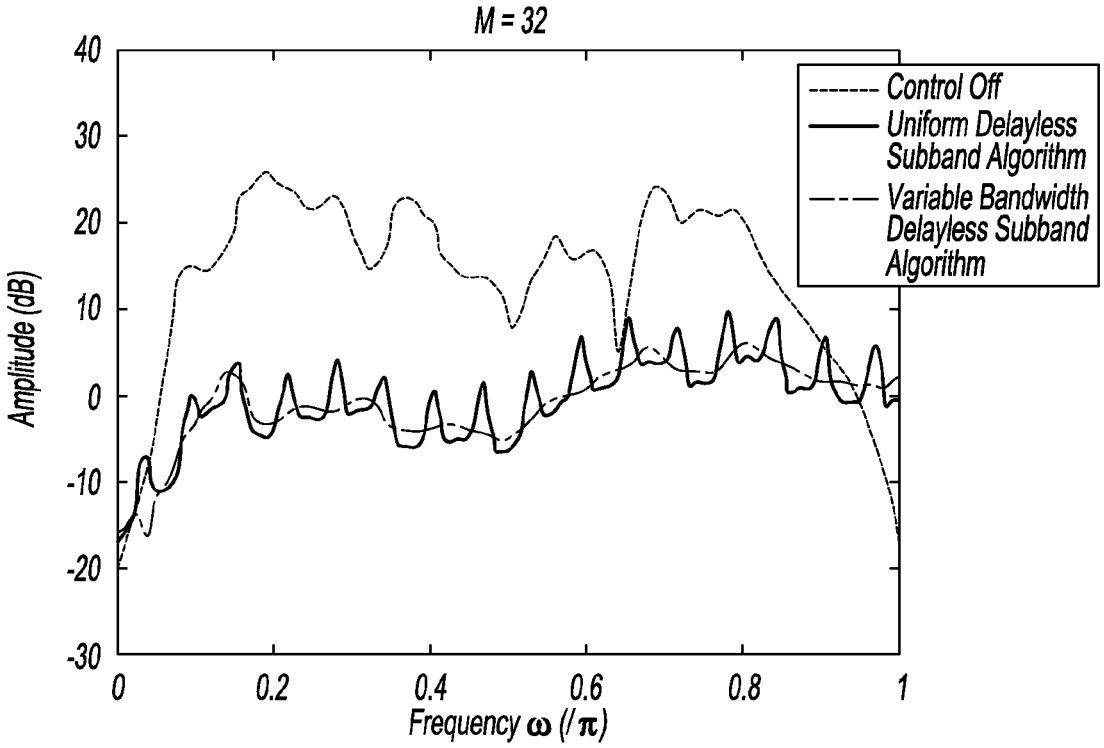
Figure 8D:
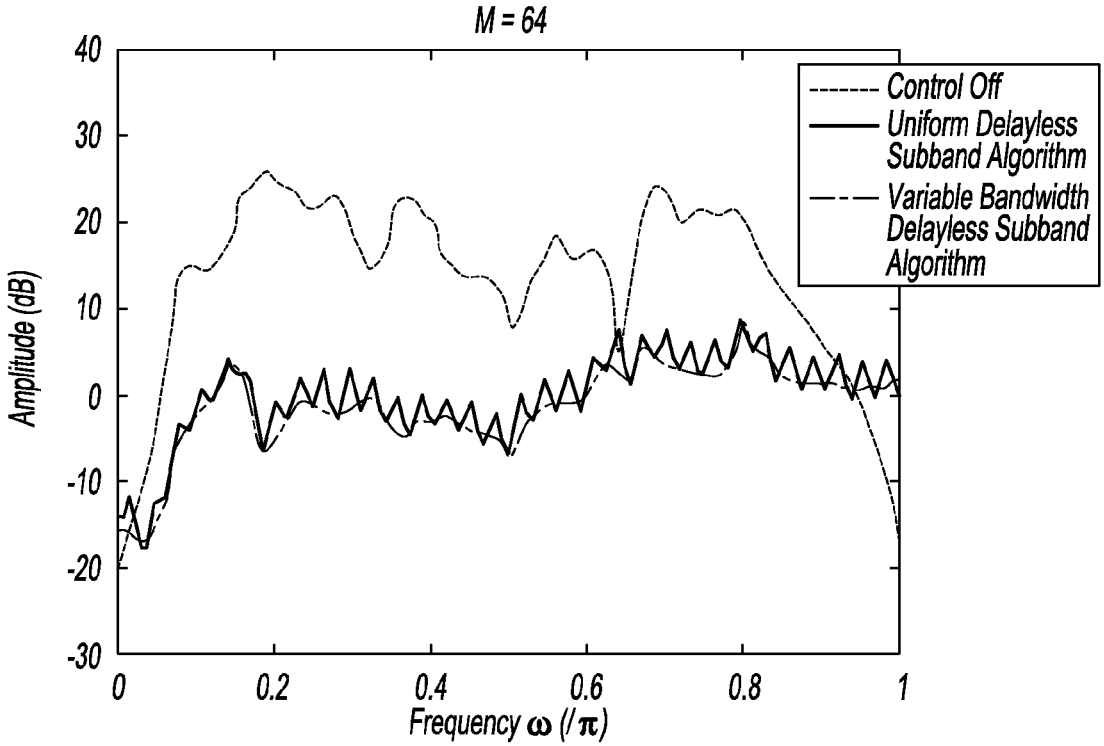

In order to evaluate the performance of the proposed algorithms, extensive numerical simulations were conducted. In the first set of simulations, broadband white noise disturbances were synthesized in MATLAB. And, the known primary path P(z) and secondary path S(z) are used since they are widely adopted in simulation based studies of ANC. The frequency responses and secondary responses of the primary path and secondary path are shown in FIGS. 7A and 7B. The primary and secondary paths were modeled using a 256-tap FIR filter. In the second simulation, the experimental data of vehicle road noise was used to further verify the performance of the variable bandwidth delayless subband algorithm. For demonstration purposes, different numbers of subbands M were used. The simulations were conducted with uniform and variable bandwidth delayless subband algorithms for different numbers of subbands.

The results of the simulations are presented in FIGS. 8A through 8D. Different numbers of subbands were used (M=8, 16, 32, 64). The uniform delayless subband algorithm has severe aliasing in the spectra of the residual error signal, which is caused by the design of the uniform DFT analysis filter bank. And when increasing the number of the subbands, the aliasing effect cannot be avoided. When the variable bandwidth delayless subband algorithm was used, it limited the aliasing effect and retained a better performance in the spectral leakage while retaining the performance of the uniform delayless subband algorithm. These results demonstrate that the use of the proposed system provides a feasible algorithm to limit and avoid the aliasing effect.

Figure 9A:
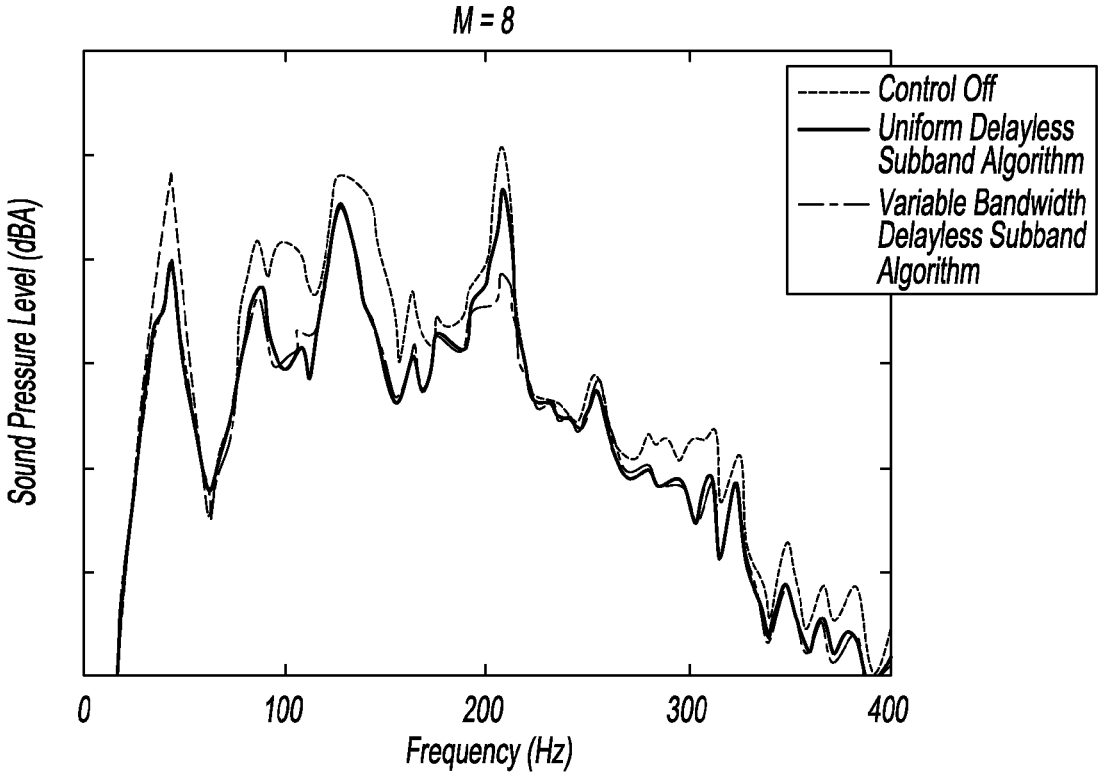
FIGS. 9A and 9B are plots of comparisons of steady-state performance of uniform and variable bandwidth delayless subband algorithms using different numbers of subbands for concrete road.
Figure 9B:
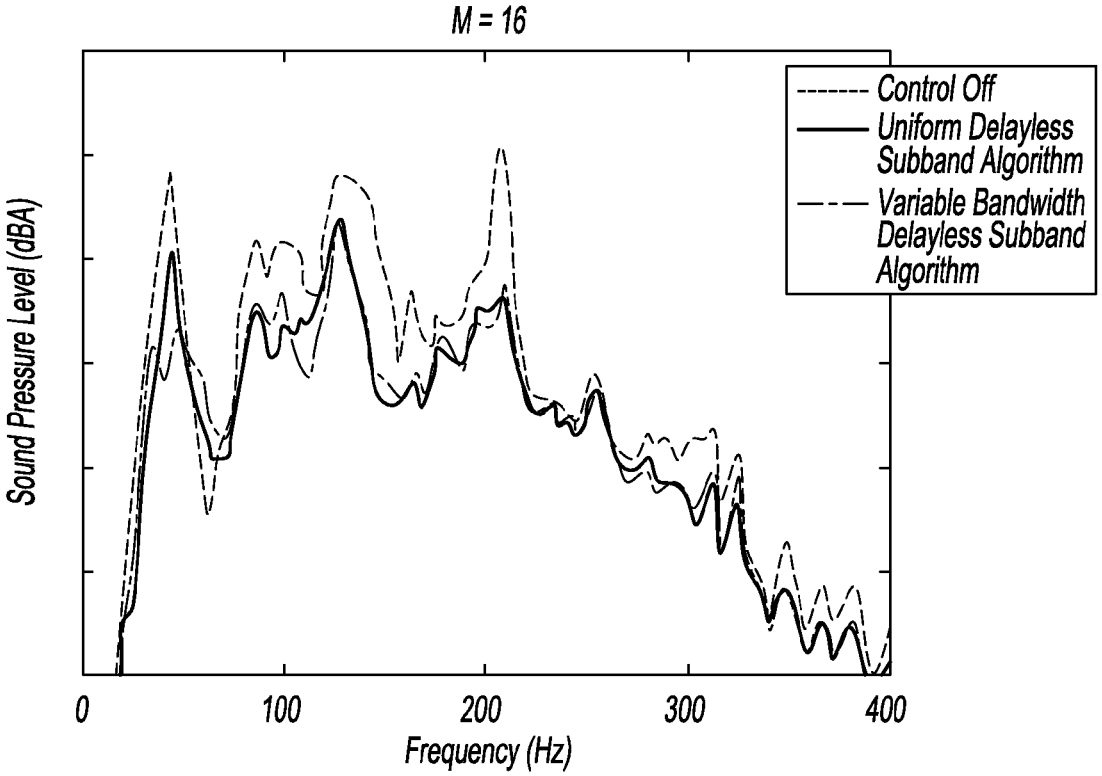
Figure 10A:
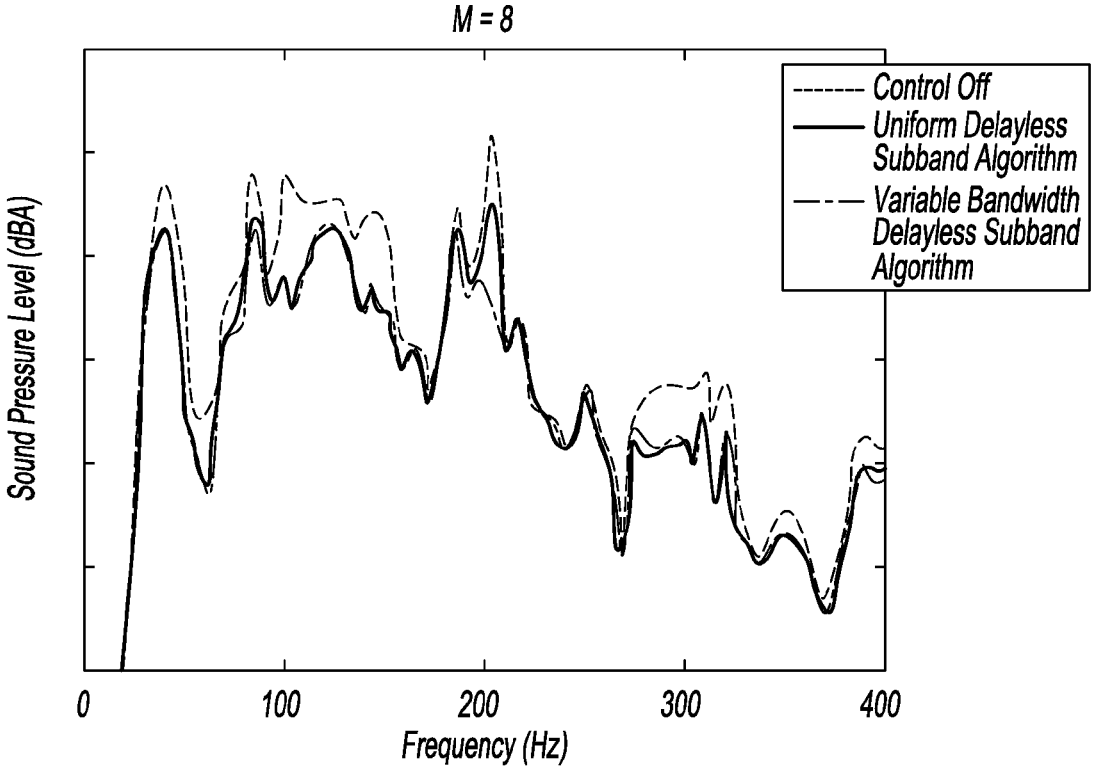
FIGS. 10A and 10B are plots of comparisons of steady-state performance of uniform and variable bandwidth delayless subband algorithms using different numbers of subbands for rough road.
Figure 10B:
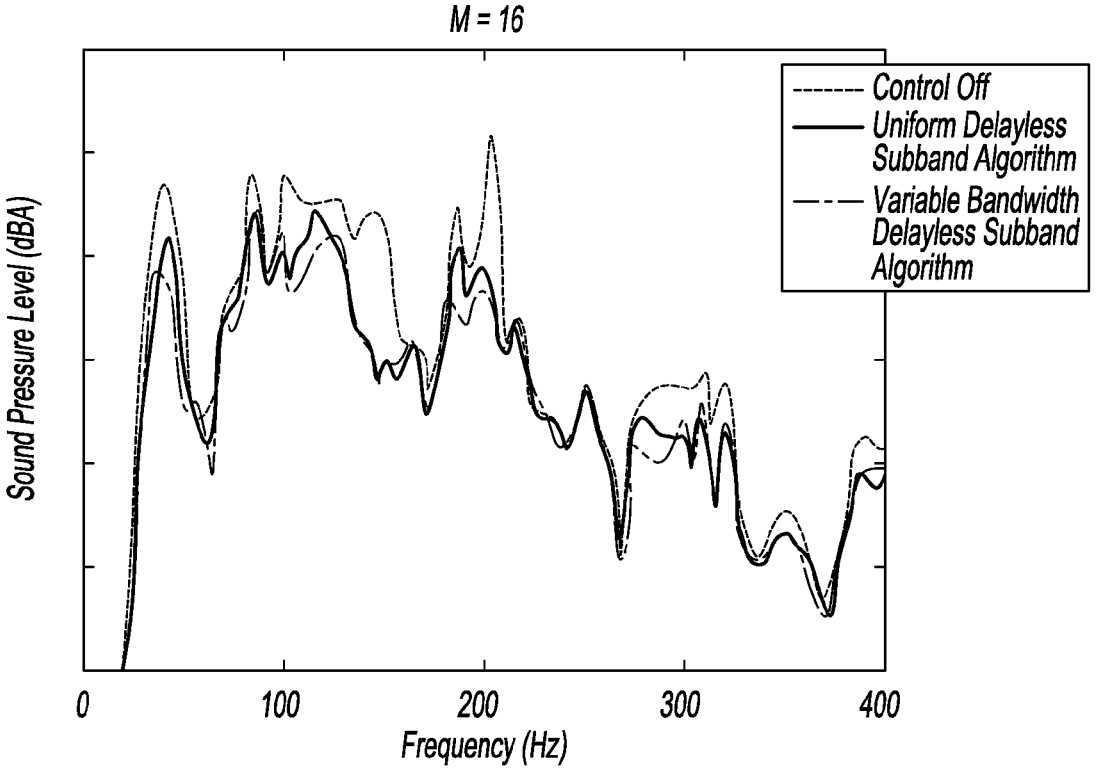

FIGS. 9A and 9B show the (concrete road) error spectra before and after convergence for the uniform and variable bandwidth delayless subband algorithms using different numbers of subbands. Similarly, FIGS. 10A and 10B show the (rough road) error spectra before and after convergence for the uniform and variable bandwidth delayless subband algorithms using different numbers of subbands (concrete road). It can be seen that the uniform and variable bandwidth delayless subband algorithms have similar performances at most frequencies. However, due to the shortcomings of the uniform DFT filter bank, the variable bandwidth DFT analysis filter bank achieved less reduction in the gaps between adjacent subbands than the uniform subband algorithm. Furthermore, simulations with different data showed that the variable bandwidth subband algorithm is effective in retaining the performance of the uniform delayless subband algorithm performance and limiting the aliasing effect in the spectral leakage.

EXAMPLE EMBODIMENTS

An active noise control system for a vehicle includes speakers, sensors configured to detect broadband white noise reference signals indicative of road noise, and a processor. The processor includes a delayless subband filtered-x least mean square control algorithm that comprises a variable bandwidth discrete Fourier transform filter bank having a number of subbands. The processor is configured to execute the delayless subband filtered-x least mean square control algorithm to process the broadband white noise reference signals and generate output exhibiting uniform gain spectrum across a frequency range defined by the subbands to partially cancel the road noise via the speakers.

An active noise control (ANC) system includes speakers, sensors, and one or more processors. The one or more processors include a delayless subband filtered-x least mean square control algorithm that comprises a variable bandwidth discrete Fourier transform filter bank having a number of subbands. A method for actively controlling noise in the ANC system includes detecting by the sensors broadband white noise reference signals indicative of road noise and having an audible frequency range of 20 Hz to 20 kHz, and executing by the one or more processors the delayless subband filtered-x least mean square control algorithm to process the broadband white noise reference signals, and generate output exhibiting uniform gain spectrum across a frequency range defined by the subbands to partially cancel the road noise via the speakers.

An active noise control (ANC) system includes a speaker, sensors configured to detect broadband white noise reference signals indicative of road noise, and one or more processors. The one or more processors include a delayless subband filtered-x least mean square control algorithm that comprises a variable bandwidth discrete Fourier transform filter bank having a number of subbands. The one or more processors are configured to execute the delayless subband filtered-x least mean square control algorithm to process the broadband white noise reference signals and generate output exhibiting uniform gain spectrum across a frequency range defined by the subbands to partially cancel the road noise via the speakers.

The processes, methods, or algorithms disclosed herein may be deliverable to or implemented by a processing device, controller, or computer, which may include any existing programmable electronic control unit or dedicated electronic control unit. Similarly, the processes, methods, or algorithms may be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms may also be implemented in a software executable object. Alternatively, the processes, methods, or algorithms may be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. An active noise control system for a vehicle comprising:

speakers;

sensors configured to detect broadband white noise reference signals indicative of road noise; and a processor including a delayless subband filtered-x least mean square control algorithm that comprises a variable bandwidth discrete Fourier transform filter bank having a number of subbands, the processor configured to execute the delayless subband filtered-x least mean square control algorithm to process the broadband white noise reference signals and generate output exhibiting uniform gain spectrum across a frequency range defined by the subbands to partially cancel the road noise via the speakers.

2. The system of claim 1, wherein the delayless subband filtered-x least mean square control algorithm further comprises a uniform filter bank and wherein center frequencies of the variable bandwidth discrete Fourier transform filter bank are offset from center frequencies of the uniform filter bank by one half a bandwidth of the uniform filter bank.

3. The system of claim 2, wherein a bandwidth of the variable bandwidth discrete Fourier transform filter bank is less than the bandwidth of the uniform filter bank.

4. The system of claim 2, wherein a bandwidth of the variable bandwidth discrete Fourier transform filter bank is at least one half the bandwidth of the uniform filter bank.

5. A method for actively controlling noise in an active noise control (ANC) system comprising speakers, sensors, and one or more processors including a delayless subband filtered-x least mean square control algorithm that comprises a variable bandwidth discrete Fourier transform filter bank having a number of subbands, the method comprising:

detecting by the sensors broadband white noise reference signals indicative of road noise and having an audible frequency range of 20 Hz to 20 kHz; and executing by the one or more processors the delayless subband filtered-x least mean square control algorithm to process the broadband white noise reference signals, and generate output exhibiting uniform gain spectrum across a frequency range defined by the subbands to partially cancel the road noise via the speakers.

6. The method of claim 5, wherein the delayless subband filtered-x least mean square control algorithm further comprises a uniform filter bank and wherein center frequencies of the variable bandwidth discrete Fourier transform filter bank are offset from center frequencies of the uniform filter bank by one half a bandwidth of the uniform filter bank.

7. The method of claim 6, wherein a bandwidth of the variable bandwidth discrete Fourier transform filter bank is less than the bandwidth of the uniform filter bank.

8. The method of claim 7, wherein a bandwidth of the variable bandwidth discrete Fourier transform filter bank is at least one half the bandwidth of the uniform filter bank.

9. An active noise control (ANC) system comprising:

a speaker;

sensors configured to detect broadband white noise reference signals indicative of road noise; and one or more processors including a delayless subband filtered-x least mean square control algorithm that comprises a variable bandwidth discrete Fourier transform filter bank having a number of subbands, the one or more processors being configured to execute the delayless subband filtered-x least mean square control algorithm to process the broadband white noise reference signals and generate output exhibiting uniform gain spectrum across a frequency range defined by the subbands to partially cancel the road noise via the speakers.

10. The system of claim 9, wherein the delayless subband filtered-x least mean square control algorithm further comprises a uniform filter bank and wherein center frequencies of the variable bandwidth discrete Fourier transform filter bank are offset from center frequencies of the uniform filter bank by one half a bandwidth of the uniform filter bank.

11. The system of claim 10, wherein a bandwidth of the variable bandwidth discrete Fourier transform filter bank is less than the bandwidth of the uniform filter bank.

12. The system of claim 10, wherein a bandwidth of the variable bandwidth discrete Fourier transform filter bank is at least one half the bandwidth of the uniform filter bank.

* * * * *